US009331411B2

(12) United States Patent
Endo

(10) Patent No.: US 9,331,411 B2
(45) Date of Patent: May 3, 2016

(54) CONNECTOR TERMINAL

(71) Applicant: DAI-ICHI SEIKO CO., LTD., Kyoto (JP)

(72) Inventor: Takayoshi Endo, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/831,606

(22) Filed: Aug. 20, 2015

(65) Prior Publication Data

US 2016/0064845 A1 Mar. 3, 2016

(30) Foreign Application Priority Data

Sep. 2, 2014 (JP) ..... 2014-178288

(51) Int. Cl.
*H01R 9/24* (2006.01)
*H01R 13/15* (2006.01)
*H01R 13/02* (2006.01)

(52) U.S. Cl.
CPC ..... *H01R 13/02* (2013.01)

(58) Field of Classification Search
CPC ..... H01R 12/721; H01R 23/70; H01R 13/432
USPC ..... 439/59, 260, 267, 269, 636–637, 862
See application file for complete search history.

(56) References Cited

U.S. PATENT DOCUMENTS

| | | | | |
|---|---|---|---|---|
| 6,679,739 | B2 | 1/2004 | Fujita | 439/862 |
| 6,804,122 | B1 * | 10/2004 | Wong | H01R 12/721 361/777 |
| 6,932,659 | B1 * | 8/2005 | Wong | H01R 13/20 439/352 |
| 8,696,372 | B2 * | 4/2014 | Endo | H01R 12/721 439/260 |
| 8,998,629 | B2 * | 4/2015 | Endo | H01R 12/72 439/260 |
| 2011/0136387 | A1 | 6/2011 | Matsuura et al. | 439/636 |

FOREIGN PATENT DOCUMENTS

| | | | |
|---|---|---|---|
| JP | 60-212982 | 10/1985 | H01R 23/70 |
| JP | 2003-7369 | 1/2003 | H01R 11/11 |
| JP | 2009-295537 | 12/2009 | H01R 12/18 |

* cited by examiner

*Primary Examiner* — Xuong Chung Trans
(74) *Attorney, Agent, or Firm* — Hayes Soloway P.C.

(57) ABSTRACT

A connector terminal to be inserted into a connector and to electrically connect with a terminal portion formed at a marginal area of a surface of a board inserted into the connector, includes an inclined portion inclining relative to the board inserted into the connector, the inclined portion being resiliently deformable when compressed by the board, a contact portion formed on the inclined portion and making contact with the terminal portion, and a projecting portion formed on the inclined portion and making contact with the board prior to the contact portion when the board is inserted into the connector, the projecting portion, when the board is inserted into the connector, making contact with an edge of the board, then riding onto the terminal portion, and then, rising away from the terminal portion when the contact portion makes contact with the terminal portion.

8 Claims, 6 Drawing Sheets

CONNECTOR TERMINAL

BACKGROUND OF THE INVENTION

1. Field of the Invention

The invention relates to a connector terminal to be used for electrical connection between devices mounted in an automobile and so on, and more particularly to a connector terminal to be inserted into a connector into which a board including a terminal portion at a marginal area on a surface thereof is also inserted.

2. Description of the Related Art

For instance, Japanese Patent Application Publication No. 2003-7369 discloses a connector into which a board including a terminal portion at a marginal area on a surface thereof is inserted.

FIG. 7 is a perspective view of a terminal metal contact of the connector disclosed in the above-identified Publication, FIG. 8 is a cross-sectional view of a housing into which the terminal metal contact is inserted, and a second connector into which the housing is to be inserted, and FIG. 9 is a cross-sectional view of the housing and the second connector into which the housing is inserted.

A terminal metal contact 100 illustrated in FIG. 7 is assembled into a card edge connector 110, as illustrated in FIG. 8. As illustrated in FIGS. 8 and 9, the card edge connector 110 is fit into a hood 121 of a second connector 120. In a condition in which the card edge connector 110 is fit into the hood 121, as illustrated in FIG. 9, a circuit board 122 is inserted at a marginal portion thereof into a fit space 112 of a housing 111, and is sandwiched between resilient contact pieces 101 of the terminal metal contacts 100 located above and below the circuit board 122, to resiliently deform the resilient contact pieces 101. Thus, the resilient contact pieces 101 make resilient contact with upper and lower surfaces of the circuit board 122 at a certain contact pressure derived from resilient recover forces thereof, and hence, make mechanical and electrical contact with a terminal portion formed at a marginal area on the surface of the circuit board 122.

The resilient piece 101 is substantially U-shaped. A substantially U-shaped semicircular portion of the resilient piece 101, when it is in a free condition in which it is not resiliently deformed, defines a contact portion 101A upwardly projecting beyond upper edges of sidewalls 102L and 102R. The contact portion 101A makes resilient contact with the upper or lower surface of the circuit board 122.

Such a connector into which the circuit board including the terminal portion at the marginal area on the surface thereof is inserted is accompanied with a problem in that if the circuit board 122 of the second connector 120 is not chamfered at front corners thereof, the contact portion 101A may be shaved at a surface thereof when the contact portion 101A of the resilient piece 101 advances onto the surface of the circuit board 122. If the contact portion 101A were shaved at the surface thereof, the contact portion 101A would make unstable contact with the circuit board 122, resulting in an increase in a contact resistance therebetween and unstable electric connection therebetween.

SUMMARY OF THE INVENTION

In view of the above-mentioned problem in the conventional electric connector, it is an object of the present invention to provide a connector terminal capable of preventing a contact portion from being shaved by a front edge of a circuit board to be inserted into a connector, to accomplish stable connection between a contact portion and a terminal portion of the circuit board, and further, prevent a contact resistance from increasing at the contact portion, and accomplish stable electric connection between the contact portion and the circuit board.

In one aspect of the present invention, there is provided a connector terminal to be inserted into a connector and to electrically connect with a terminal portion formed at a marginal area of a surface of a board inserted into the connector, the connector terminal including an inclined portion inclining relative to the board inserted into the connector, the inclined portion being resiliently deformable when compressed by the board, at least one contact portion formed on the inclined portion and making contact with the terminal portion of the board, and at least one projecting portion formed on the inclined portion and making contact with the board prior to the contact portion when the board is inserted into the connector, the projecting portion, when the board is inserted into the connector, making contact with an edge of the board, then riding onto the terminal portion of the board, and then, rising away from the terminal portion of the board when the contact portion makes contact with the terminal portion of the board.

In the connector terminal in accordance with the present invention, when the circuit board is inserted into the connector, the projecting portion makes contact with the front edge of the circuit board earlier than the contact portion, and then, advances onto a terminal portion of the circuit board. When the circuit board is inserted further into a connector, the contact portion makes contact with the front edge of the circuit board, and then, advances onto the circuit board, in which case, since the projecting portion first makes contact with the circuit board to resiliently deform the inclined portion, the inclined portion inclines at a smaller inclination angle than before. Furthermore, since the inclined portion is resiliently deformed in a smaller degree than before when the contact portion advances onto the circuit board, the contact portion is able to advance onto the circuit board with a reduced load, ensuring it possible to prevent the contact portion from being shaved by the front edge of the circuit board inserted into the connector. Furthermore, when the contact portion makes contact with the terminal portion of the circuit board and then advances onto the same, the projecting portion is caused to be away from the terminal portion of the circuit board, and thus, only the contact portion makes contact with the terminal portion of the circuit board, ensuring stable contact between the contact portion and the terminal portion of the circuit board.

It is preferable that the projecting portion have an arcuate surface.

By designing so, the projecting portion is able to make smooth contact with the circuit board and then advances onto the same when the circuit board is inserted into the connector, ensuring it possible to reduce a resistance with which the projecting portion advances onto the circuit board.

It is preferable that the contact portion and the projecting portion be situated so as not to overlap each other when viewed in a direction in which the board is inserted into the connector.

By designing so, it is possible to cause the projecting portion to make contact with the circuit board at a location other than the terminal portion with which the contact portion makes contact when the circuit board is inserted into a connector, ensuring it possible to prevent the projecting portion from making contact with and causing damage to the terminal portion of the circuit board with which the contact portion makes contact.

For instance, the connector terminal may be designed to include one contact portion and two projecting portions, the projecting portions being situated each outside of the contact portion when viewed in a direction in which the board is inserted into the connector.

For instance, the connector terminal may be designed to include two contact portions and one projecting portion, the contact portions being situated each outside of the projecting portion when viewed in a direction in which the board is inserted into the connector.

The advantages obtained by the aforementioned present invention will be described hereinbelow.

The connector terminal in accordance with the present invention is designed to include the inclined portion inclining relative to the board inserted into the connector, the inclined portion being resiliently deformable when compressed by the board, at least one contact portion formed on the inclined portion and making contact with the terminal portion of the board, and at least one projecting portion formed on the inclined portion and making contact with the board prior to the contact portion when the board is inserted into the connector, the projecting portion, when the board is inserted into the connector, making contact with an edge of the board, then riding onto the terminal portion of the board, and then, rising away from the terminal portion of the board when the contact portion makes contact with the terminal portion of the board. The connector terminal prevents the contact portion from being shaved by the front edge of the circuit board inserted into the connector, ensuring stable contact between the contact portion and the terminal portion of the circuit board, and accordingly, preventing a contact resistance at the contact portion from increasing, and accomplishing stable electric connection between the contact portion and the circuit board.

By designing the projecting portion to have an arcuate surface, it is possible to reduce a resistance with which the projecting portion rides onto the circuit board when the circuit board is inserted into the connector, ensuring that the circuit board can be inserted smoothly into the connector.

By designing the contact portion and the projecting portion to be situated so as not to overlap each other when viewed in a direction in which the board is inserted into the connector, it is possible to prevent the projecting portion from damaging the terminal portion of the circuit board by making contact with the same with which the contact portion makes contact when the circuit board is inserted into the connector. It is further possible to prevent a contact resistance at the contact portion from increasing, and to accomplish stable electric connection between the contact portion and the circuit board.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

[First Embodiment]

Figure 1:
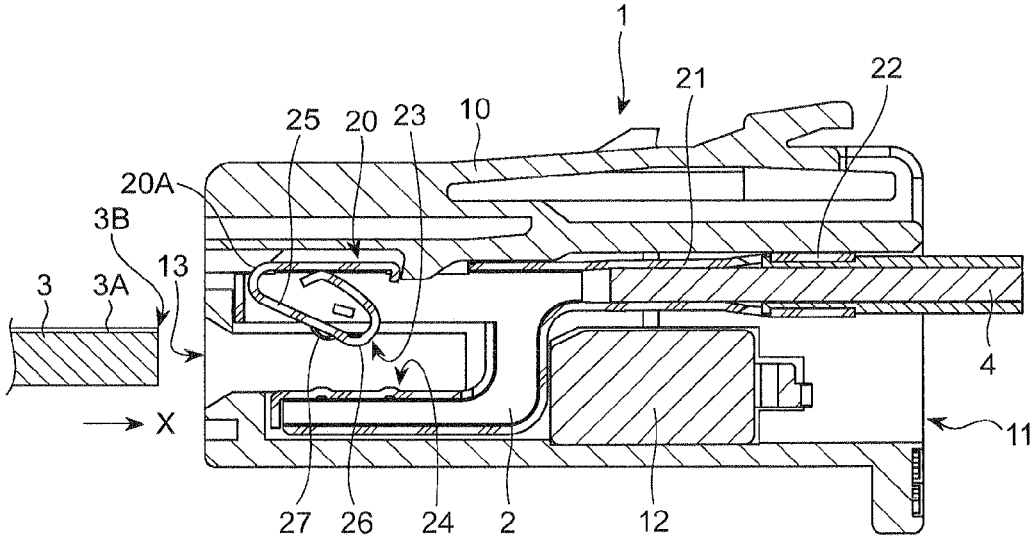
FIG. 1 is a cross-sectional view of a connector including a connector terminal in accordance with a first embodiment of the present invention.
Figure 2:
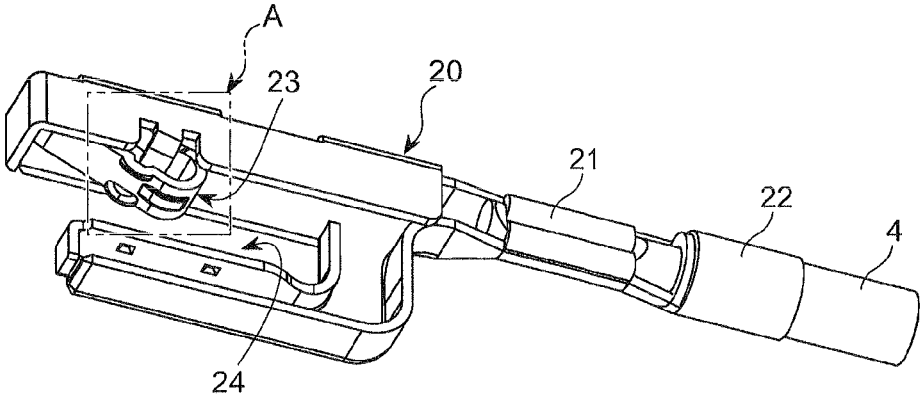
FIG. 2 is a perspective view of the connector terminal illustrated in FIG. 1 when viewed obliquely from the bottom.
Figure 3:
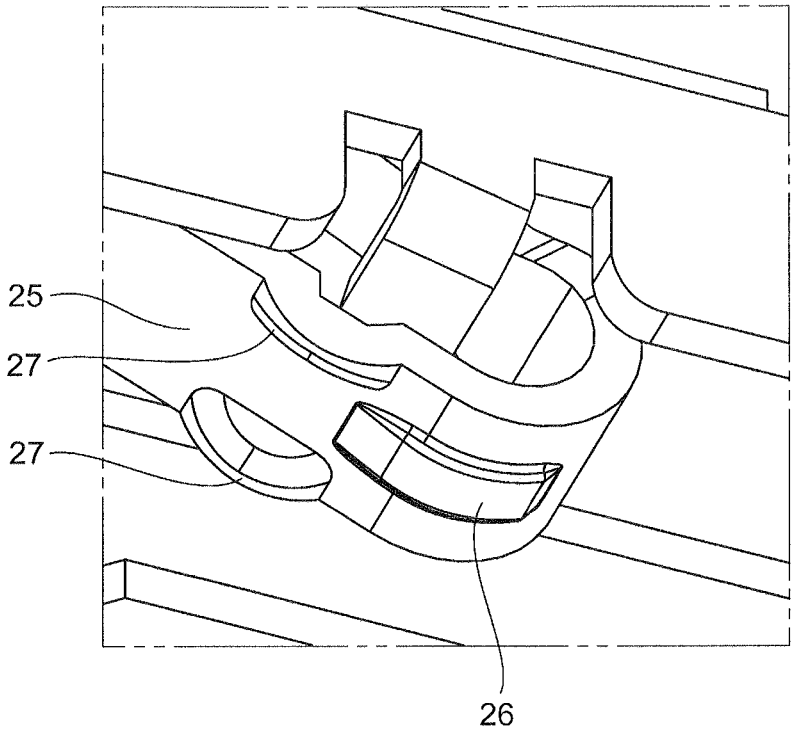
FIG. 3 is an enlarged view of a portion A indicated in FIG. 2.

FIG. 1 is a cross-sectional view of a connector including a connector terminal in accordance with a first embodiment of the present invention, FIG. 2 is a perspective view of the connector terminal illustrated in FIG. 1 when viewed obliquely from the bottom, and FIG. 3 is an enlarged view of a portion A indicated in FIG. 2.

In FIG. 1, a connector 1 includes a connector terminal 2 in accordance with the first embodiment, a circuit board 3, and a connector housing 10.

The circuit board 3, which includes a terminal portion 3A formed at a marginal area on a surface thereof, is inserted into the connector housing 10 into which the connector terminal 2 in accordance with the first embodiment is also inserted. The connector terminal 2 is inserted into the connector housing 10 through an opening 11 formed at a rear (on a right-side in FIG. 1) end of the connector housing 10, and is fixed in the connector housing 10 by means of a retainer 12 so as not to be pulled out of the connector housing 10 through the rear end of the connector housing 10. The circuit board 3 is inserted into the connector housing 10 through an opening 13 formed at a front (on a left-side in FIG. 1) end of the connector housing 10. In the specification, a wording "front" is toward the front of a direction X in which the circuit board 3 is inserted into the connector housing 10, and a wording "rear" is toward the rear of the direction X.

The connector terminal 2 is manufactured by processing a flat metal sheet having electric conductivity. The connector terminal 2 includes a terminal body 20 for sandwiching the circuit board 3 therein, a cable-fixing section 21 at which a cable 4 is compressed, and a cable holder 22 by which the cable 4 is bundled. The terminal body 20 includes a resilient contact portion 23 making resilient contact with the terminal portion 3A of the circuit board 3, and a board receiver 24 disposed in facing relation with the resilient contact portion 23. The circuit board 3 is sandwiched between the resilient contact portion 23 and the board receiver 24.

As illustrated in FIG. 3, the resilient contact portion 23 includes an inclined portion 25 being resiliently deformable when compressed by the circuit board 3, a contact portion 26 formed on the inclined portion 25 and making contact with the terminal portion 3A of the circuit board 3, and two projecting portions 27 formed on the inclined portion 25.

The inclined portion 25 is formed by bending a stripped portion towards the front (right-side in FIG. 1) of the direction X. Namely, the inclined portion 25 extends in the direction X from a base portion 20A located at a rear (left-side in FIG. 1) end of the terminal body 20 such that a front (right-side in FIG. 1) end thereof is close to the board receiver 24. Thus, the inclined portion 25 inclines relative to the circuit board 3 inserted into the connector housing 10. The inclined portion 25 is then bent at the front end thereof in a direction away from the circuit board 3 (upwardly in FIG. 1), and further bent towards the rear of the direction X.

The contact portion 26 is disposed on a bent portion of the inclined portion 25 at the front end of the inclined portion 25. The projecting portions 27 downwardly project, and are located closer to the opening 13 of the connector housing 10 than the contact portion 26. The projecting portions 27 have an arcuate cross-section, and have a smooth surface.

The contact portion 26 and the projecting portions 27 are arranged to be disposed not to overlap each other when viewed in the direction X. When viewed in the direction X, the contact portion 26 is disposed between the projecting portions 27.

Figure 4A:
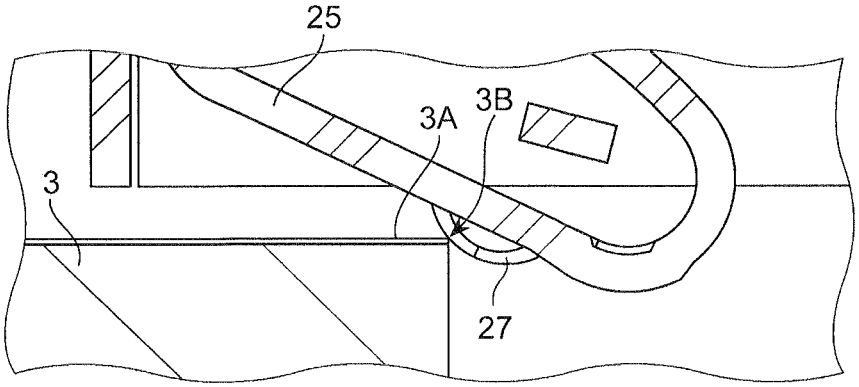
FIG. 4A is an enlarged cross-sectional view illustrating a step of inserting a circuit board into the connector terminal.
Figure 4B:
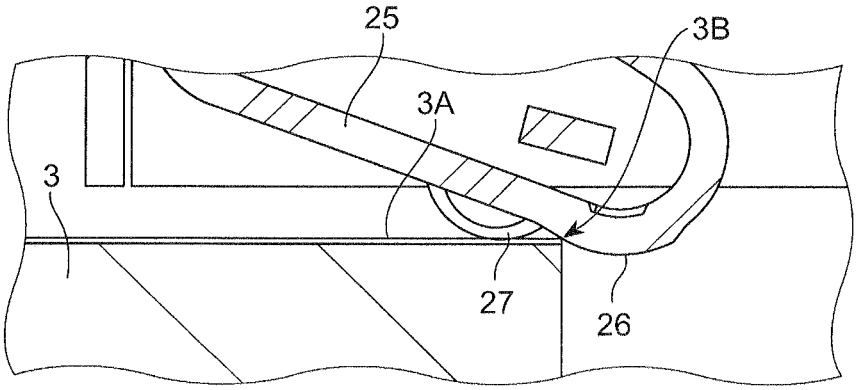
FIG. 4B is an enlarged cross-sectional view illustrating the step of inserting the circuit board into the connector terminal.
Figure 4C:
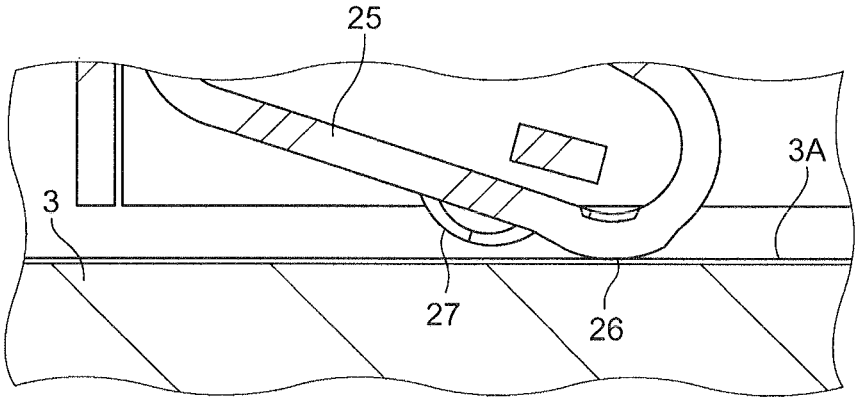
FIG. 4C is an enlarged cross-sectional view illustrating the step of inserting the circuit board into the connector terminal.

FIGS. 4A to 4C are enlarged cross-sectional views each illustrating a step of inserting the circuit board 3 into the connector terminal 2.

As illustrated in FIG. 4A, when the circuit board 3 is inserted into the connector terminal 2, the circuit board 3 first makes contact, at a front edge 3B thereof, with the projecting portions 27 to upwardly resiliently deform the inclined portion 25. Thus, the projecting portions 27 advance or ride onto an upper surface of the circuit board 3.

When the circuit board 3 is further inserted into the connector terminal 2, as illustrated in FIG. 4B, the contact portion 26 makes contact with the front edge 3B of the circuit board 3, and then, as illustrated in FIG. 4C, rides onto the upper surface of the circuit board 3. Since the projecting portions 27 first make contact with the circuit board 3 to upwardly resiliently deform the inclined portion 25, the inclined portion 25 inclines at a smaller inclination angle than an initial inclination angle. Furthermore, the inclined portion 25 is resiliently deformed at a smaller degree when the contact portion 26 rides onto the upper surface of the circuit board 3. This reduces a load exerted on the contact portion 26 when the contact portion 26 rides onto the upper surface of the circuit board 3, which prevents the contact portion 26 from being shaved by the front edge 3B of the circuit board 3 inserted into the connector terminal 2.

As illustrated in FIG. 4C, when the contact portion 26 rides onto the terminal portion 3A of the circuit board 3, the projecting portions 27 rise away from the terminal portion 3A of the circuit board 3. Thus, since only the contact portion 26 makes contact with the terminal portion 3A of the circuit board 3, the contact portion 26 is able to make stable contact with the terminal portion 3A of the circuit board 3, which prevents increase in a contact resistance at the contact portion 26 to accomplish stable electrical connection between the circuit board 3 and the connector terminal 2.

Furthermore since the projecting portions 27 of the connector terminal 2 in accordance with the first embodiment are designed to be arcuate in the form and have a smooth surface, the projecting portions 27 are able to make smooth contact with the circuit board 3 and smoothly ride onto the circuit board 3 when the circuit board 3 is inserted into the connector terminal 2. Thus, it is possible to reduce a resistance with which the projecting portions 27 ride onto the circuit board 3, ensuring that the circuit board 3 can be smoothly inserted into the connector terminal 2.

In the connector terminal 2 in accordance with the first embodiment, the contact portion 26 and the projecting portions 27 are arranged to be disposed not to overlap each other when viewed in the direction X. The projecting portions 27 thus make contact with a portion of the circuit board 3 other than the terminal portion 3A of the circuit board 3 with which the contact portion 26 makes contact while the circuit board 3 is being inserted into the connector terminal 2. This prevents the projecting portions 27 from making contact with and causing damage to the terminal portions 3A of the circuit board 3 with which the contact portion 26 makes contact.

[Second Embodiment]

Figure 5:
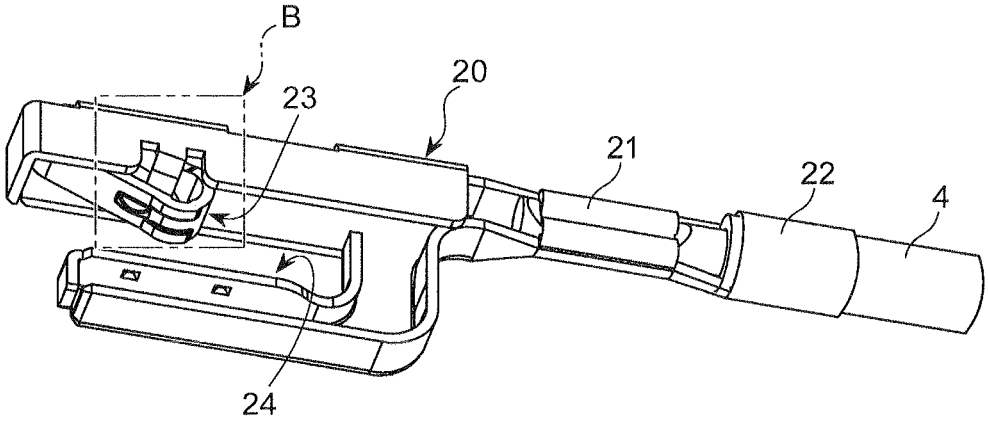
FIG. 5 is a perspective view of the connector terminal in accordance with a second embodiment, when viewed obliquely from the bottom.
Figure 6:
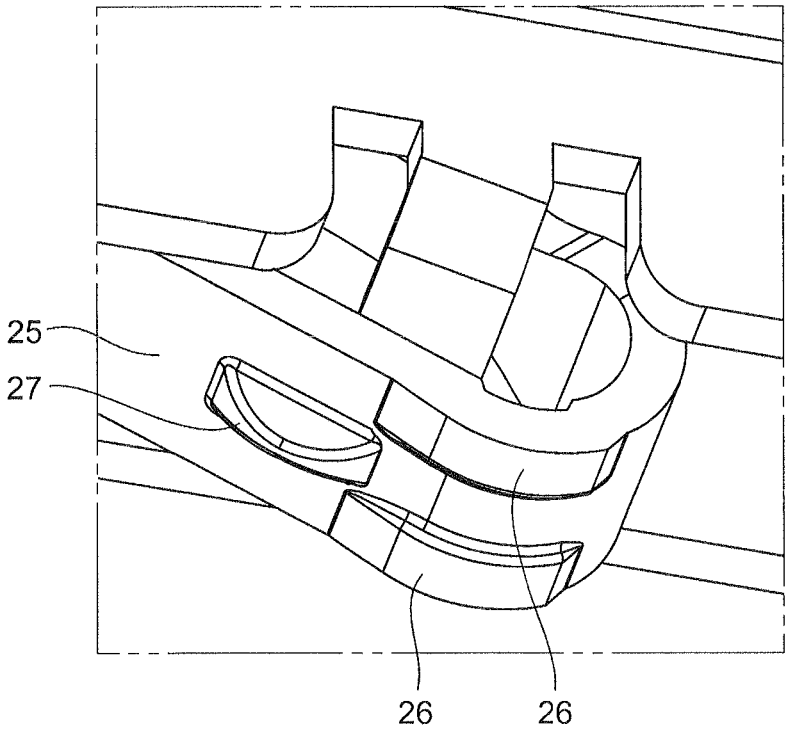
FIG. 6 is an enlarged view of a portion B indicated in FIG. 5.
Figure 7:
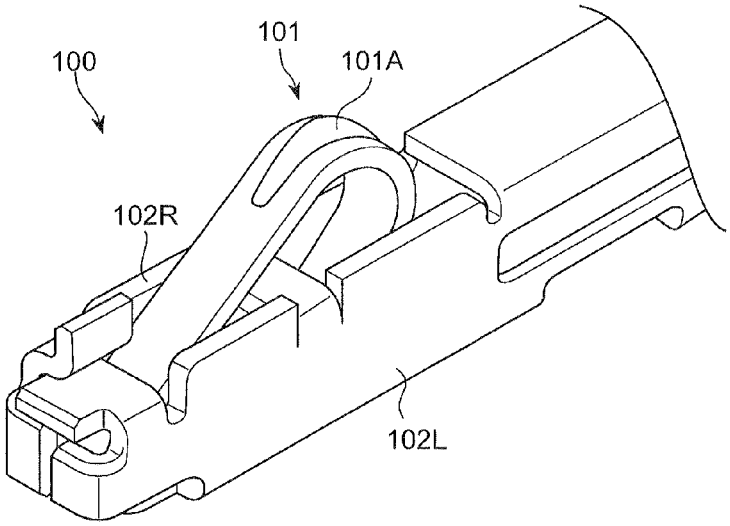
FIG. 7 is a perspective view of a terminal metal contact of a conventional connector.
Figure 8:
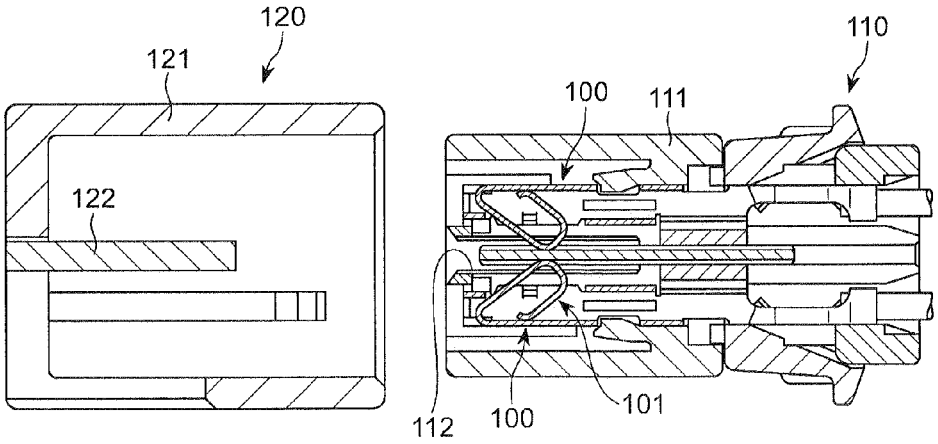
FIG. 8 is a cross-sectional view of a housing into which the terminal metal contact illustrated in FIG. 7 is inserted, and a second connector into which the housing is to be inserted, both of which are separated from each other.
Figure 9:
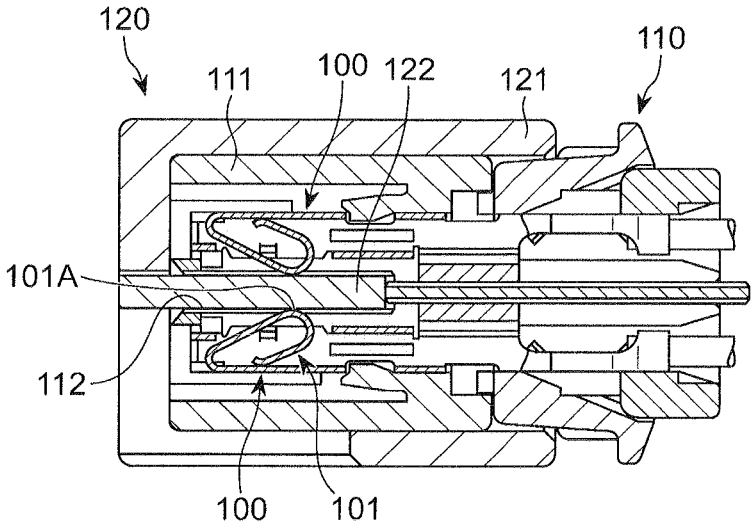
FIG. 9 is a cross-sectional view of the housing into which the terminal metal contact illustrated in FIG. 7 is inserted, and the second connector into which the housing is to be inserted, both of which are fit into each other.

FIG. 5 is a perspective view of the connector terminal in accordance with a second embodiment, and FIG. 6 is an enlarged view of a portion B indicated in FIG. 5.

The connector terminal 2 in accordance with the above-mentioned first embodiment is designed to include one contact portion 26 and two projecting portions 27, in which the contact portion 26 is disposed between the projecting portions 27 when viewed in the direction X.

As illustrated in FIGS. 5 and 6, the connector terminal in accordance with the second embodiment is designed to include two contact portions 26 and one projecting portion 27.

The projecting portion 27 is located closer to the opening 13 of the connector housing 10 than the contact portions 26.

The projecting portion 27 is disposed between the contact portions 26 when viewed in the direction X. Similarly to the connector terminal 2 in accordance with the first embodiment, the contact portions 26 and the projecting portion 27 are disposed so as not to overlap each other when viewed in the direction X.

The connector terminal in accordance with the second embodiment provides not only the same advantages as those provided by the connector terminal 2 in accordance with the first embodiment, but also the additional advantage. Since the connector terminal makes contact with the circuit board 3 at two points, that is, at the two contact portions 26, the contact portions 26 are able to make contact with the terminal portion 3A of the circuit board 3 more stably than the contact portion 26 of the first embodiment.

INDUSTRIAL APPLICABILITY

The connector terminal in accordance with the present invention is useful to a connector into which a circuit board including a terminal portion at a marginal area on a surface thereof is to be inserted.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2014-178288 filed on Sep. 2, 2014 including specification, claims, drawings and summary is incorporated herein by reference in its entirety.

What is claimed is:

1. A connector terminal to be inserted into a connector and to electrically connect with a terminal portion formed at a marginal area of a surface of a board inserted into said connector, said connector terminal including:

an inclined portion inclining relative to said board inserted into said connector, said inclined portion being resiliently deformable when compressed by said board;

at least one contact portion formed on said inclined portion and making contact with said terminal portion of said board; and at least one projecting portion formed on said inclined portion and making contact with said board prior to said contact portion when said board is inserted into said connector, said projecting portion, when said board is inserted into said connector, making contact with an edge of said board, then riding onto said terminal portion of said board, and then, rising away from said terminal portion of said board when said contact portion makes contact with said terminal portion of said board.

2. The connector terminal as set forth in claim 1, wherein said projecting portion has an arcuate surface.

3. The connector terminal as set forth in claim 1, wherein said contact portion and said projecting portion are situated so as not to overlap each other when viewed in a direction in which said board is inserted into said connector.

4. The connector terminal as set forth in claim 2, wherein said contact portion and said projecting portion are situated so as not to overlap each other when viewed in a direction in which said board is inserted into said connector.

5. The connector terminal as set forth in claim 3, wherein said connector terminal includes one contact portion and two projecting portions, said projecting portions being situated each outside of said contact portion when viewed in a direction in which said board is inserted into said connector.

6. The connector terminal as set forth in claim 4, wherein said connector terminal includes one contact portion and two projecting portions, said projecting portions being situated each outside of said contact portion when viewed in a direction in which said board is inserted into said connector.

7. The connector terminal as set forth in claim 3, wherein said connector terminal includes two contact portions and one projecting portion, said contact portions being situated each outside of said projecting portion when viewed in a direction in which said board is inserted into said connector.

8. The connector terminal as set forth in claim 4, wherein said connector terminal includes two contact portions and one projecting portion, said contact portions being situated each outside of said projecting portion when viewed in a direction in which said board is inserted into said connector.

* * * * *